US009010146B1

(12) United States Patent
Wiegert

(10) Patent No.: US 9,010,146 B1
(45) Date of Patent: Apr. 21, 2015

(54) WEARABLE DECORATIVE ARTICLES

(76) Inventor: Nava Wiegert, Caro, MI (US)

( * ) Notice: Subject to any disclaimer, the term of this patent is extended or adjusted under 35 U.S.C. 154(b) by 0 days.

(21) Appl. No.: 10/771,203

(22) Filed: Feb. 3, 2004

(51) Int. Cl.
*A44C 9/00* (2006.01)

(52) U.S. Cl.
CPC ..... *A44C 9/0015* (2013.01)

(58) Field of Classification Search
CPC ..... A44C 9/00; A44C 9/0007; A44C 9/0015; A44C 9/0023
USPC ..... 63/15.1, 15.2, 15.3, 15.5, 15.65, 9, 63/15.4, 15.7, 3, 5.1, 3.1, 15; 24/21, 24/581.1, 574.1, 573.09, 581.11; 70/16, 70/18, 456 R, 457, 459; 273/156, 157 R; 403/353, 344; 446/117, 124, 126, 127
See application file for complete search history.

(56) References Cited

U.S. PATENT DOCUMENTS

| | | | | | |
|---|---|---|---|---|---|
| 56,894 | A | * | 8/1866 | Brown | 24/30.5 R |
| 241,453 | A | * | 5/1881 | Untermeyer | 63/29.1 |
| 1,558,418 | A | * | 10/1925 | Wendel | 63/15.65 |
| 1,866,320 | A | * | 7/1932 | Roskin | 63/15.4 |
| 1,995,517 | A | * | 3/1935 | Neugass | 63/4 |
| 2,072,440 | A | * | 3/1937 | Bauer et al. | 63/15.7 |
| 2,146,272 | A | * | 2/1939 | Skoog | 63/15.65 |
| 2,177,314 | A | * | 10/1939 | Von Dachenhausen | 63/15.4 |
| 2,497,207 | A | * | 2/1950 | Burk | 63/15.7 |
| 2,771,753 | A | * | 11/1956 | Sallan | 63/15.7 |
| 3,177,682 | A | | 4/1965 | Razza | |
| 3,228,208 | A | * | 1/1966 | Silverman | 63/15.65 |
| 3,246,388 | A | * | 4/1966 | Pasquale | 29/896.412 |
| 3,263,444 | A | * | 8/1966 | Di Croce | 63/15.7 |
| 3,307,375 | A | * | 3/1967 | Estrin et al. | 63/15 |
| 3,423,956 | A | * | 1/1969 | Manne | 63/15.45 |
| 3,619,913 | A | | 3/1970 | Albrecht | |
| 3,566,616 | A | * | 3/1971 | Benedict, Jr. | 63/15.7 |
| 3,635,047 | A | | 1/1972 | Gilbert | |
| 4,142,382 | A | * | 3/1979 | Fix et al. | 63/15.9 |
| 4,608,838 | A | | 9/1986 | Gardner | |
| 4,697,437 | A | * | 10/1987 | D'Annunzio | 63/15.5 |
| 4,765,154 | A | * | 8/1988 | Martin | 63/23 |
| 4,790,148 | A | * | 12/1988 | Faini | 63/15.7 |
| 4,905,482 | A | | 3/1990 | Gheblikian | |

(Continued)

OTHER PUBLICATIONS

Metalwerx. Product photograph [online]. Original publication date unknown. Retrieved [Jun. 9, 2006] Retrieved from the Internet: <URL:http://www.metalwerx.com/gallery/index.php?gallery=./4&image=Yfriedman2.jpeg>.

(Continued)

*Primary Examiner* — Jack W Lavinder
*Assistant Examiner* — Abigail Morrell
(74) *Attorney, Agent, or Firm* — Dickinson Wright PLLC

(57) ABSTRACT

The specification describes a wearable decorative article comprising at least first and second separate body components selectively inter-relatable with each other in a predetermined order of assembly to thereby define a unitary article, such as, for example, a ring, pendant, watch, etc. When the at least first and second separate body components are assembled to define the unitary article, at least the first and second separate body components further define a bounded opening dimensioned to receive a retaining member, such as, for instance, a finger or neck-encircling band, wrist, etc. therein. The unitary article is characterized in that it can be completely disassembled into the at least first and second separate body components only if a retaining member is not present in the bounded opening.

3 Claims, 4 Drawing Sheets

(56) References Cited

U.S. PATENT DOCUMENTS

| | | | | | |
|---|---|---|---|---|---|
| 5,131,243 | A | * | 7/1992 | Coleman | 63/15.65 |
| 5,133,195 | A | | 7/1992 | Appelbaum et al. | |
| 5,177,983 | A | | 1/1993 | Terada et al. | |
| 5,186,023 | A | * | 2/1993 | Goldberg | 63/15.5 |
| 5,228,316 | A | * | 7/1993 | Meyrowitz | 63/15.4 |
| 5,228,317 | A | * | 7/1993 | Hendricks | 63/15.7 |
| 5,253,490 | A | * | 10/1993 | Doganay | 63/15.4 |
| 5,353,608 | A | * | 10/1994 | Berkowitz | 63/33 |
| 5,412,956 | A | * | 5/1995 | Levy | 63/15.65 |
| 5,417,085 | A | * | 5/1995 | Regev | 63/15.2 |
| 5,419,158 | A | * | 5/1995 | Sandberg et al. | 63/15.4 |
| 5,544,511 | A | * | 8/1996 | Cavaleri | 70/457 |
| 5,596,887 | A | * | 1/1997 | Bergagnini | 63/15.1 |
| 5,669,241 | A | * | 9/1997 | Kohl | 63/15.2 |
| 5,727,399 | A | * | 3/1998 | Bergagnini | 63/15.4 |
| 5,735,144 | A | * | 4/1998 | Gabel | 63/15.1 |
| 5,806,344 | A | * | 9/1998 | Bonchek | 63/15.1 |
| 6,131,408 | A | | 10/2000 | Gill | |
| 6,318,122 | B1 | * | 11/2001 | Burgard | 63/29.1 |
| 6,484,536 | B1 | * | 11/2002 | Gould | 63/15.1 |
| 6,508,079 | B2 | | 1/2003 | Wolff | |
| 6,550,276 | B2 | | 4/2003 | Frank | |
| 6,568,214 | B2 | | 5/2003 | Wolff | |
| 6,574,989 | B1 | * | 6/2003 | Lampert | 63/15 |
| 6,715,315 | B1 | * | 4/2004 | Hartgrove | 63/29.2 |
| 7,013,674 | B2 | * | 3/2006 | Kretchmer | 63/5.1 |
| 2002/0178749 | A1 | * | 12/2002 | Katano | 63/15.7 |
| 2002/0189285 | A1 | | 12/2002 | Frank | |
| 2003/0074919 | A1 | | 4/2003 | Hartgrove | |
| 2004/0200235 | A1 | * | 10/2004 | Kretchmer | 63/3 |
| 2004/0255620 | A1 | * | 12/2004 | Chuang | 63/29.1 |

OTHER PUBLICATIONS

Metalwerx. Product photograph [online]. Original publication date unknown. Retrieved [Jun. 9, 2006] Retrieved from the Internet: <URL:http://www.metalwerx.com/gallery/index.php?gallery=./4 &image=Yfriedman18.jpeg>.

Metalwerx. Product photograph [online]. Original publication date unknown. Retrieved [Jun. 9, 2006] Retrieved from the Internet: <URL:http://www.metalwerx.com/gallery/index.php?gallery=./4 &image=Yfriedman7.jpeg>.

* cited by examiner

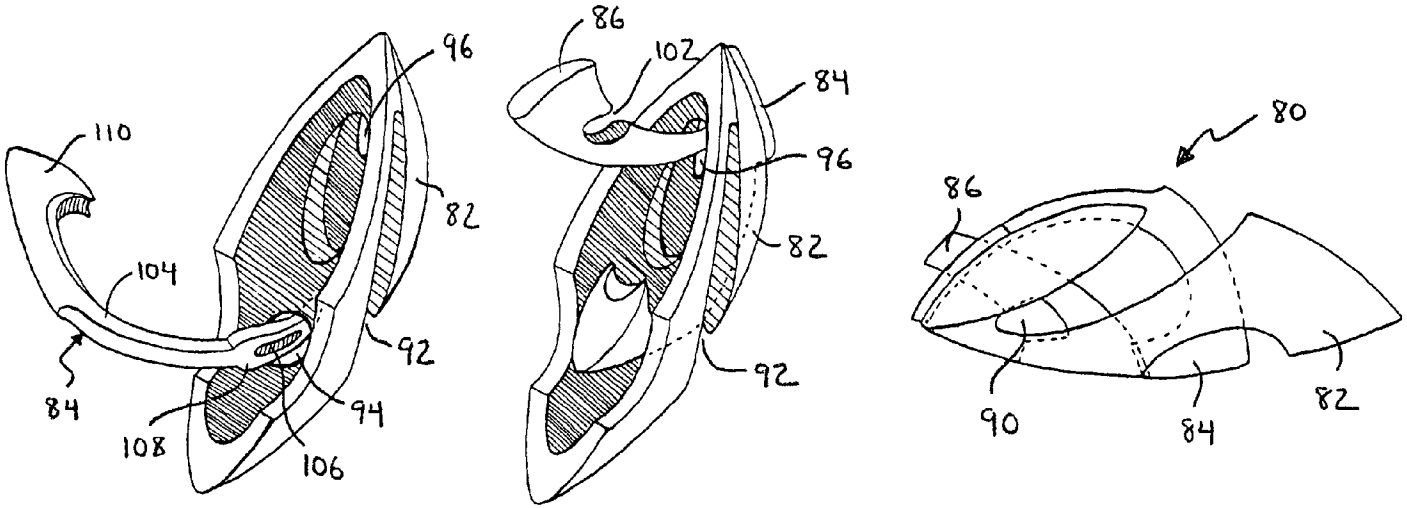
FIGURE 3d
FIGURE 3c
FIGURE 3b
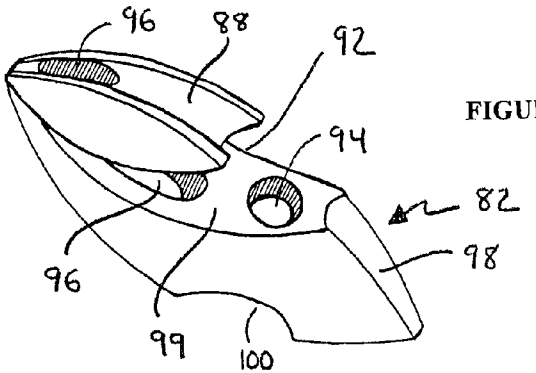
FIGURE 3a

WEARABLE DECORATIVE ARTICLES

FIELD OF THE INVENTION

The present invention pertains generally to wearable decorative articles, including, for instance, jewelry such as rings, pendants, necklaces, etc., and more particularly to such wearable decorative articles including at least first and second separate body components selectively inter-relatable with each other in a predetermined order of assembly to thereby define a unitary, wearable decorative article.

BACKGROUND

Throughout history, humans have had a love affair with jewelry. Its attraction is unquestionably universal. People of every culture and creed have at one point or another found indulgence or importance in the wearing of articles ranging from the smallest sterling silver ring to the mightiest, gem-adorned headdress. Necklaces have purported to ward off curses or evil spirits. Rings have long been used to symbolize the union of two people through the sacrament of marriage, or to otherwise acknowledge pure sentimental attachment. Broaches have borne insignia of caste, class, and clan. However, the use of jewelry for simple, decorative purposes is perhaps the most widespread affair of all. A scant amount of gold, silver, or precious stone can revitalize and enhance a wardrobe, or simply draw the eye to a hand, neckline, or face. History has recorded all this and more about the significance of jewelry in human culture.

Against this many-hued tapestry that is the role of jewelry throughout human history, the inventive among us have played no small part. Inventors have found a variety of ways to incorporate the useful with the decorative. Many patents have described ways of providing a range of decorative articles using fewer actual pieces of jewelry. However, these patents generally relate to the interchangeability of decorative or detail portions only.

While the interchangeability taught in the prior art has its merits, it also has drawbacks. For instance, some inventions are directed toward jewelry pieces used for demonstration rather than adornment. And in those inventions intended for adornment, a user must resign himself or herself to the presence of an unsightly hinge or other mechanism appearing somewhere on the decorative article which detract from the overall appearance of the piece. In these instances, achieving the desired utility in the article comes at the expense of the aesthetic quality of the piece. In such a situation, it would be desirable either to conceal these mechanisms introduced by the presence of the useful components or to design them in such a way that they enhance, rather than detract from, the overall design.

Devices which attempt to conceal the presence of interchangeability mechanisms on decorative articles are known in the art. For the vast majority of these solutions, however, significant drawbacks include the short operating lives of the fine mechanical parts, as well as the expense of manufacture, for instance time and tooling costs.

What the prior art has not described is multi-part jewelry defined by the act of being worn. In all of the prior art, a ring has been a ring, whether on a finger or off of it. Similarly, a pendant has always been a pendant, whether or not it dangles from a chain or necklace. What the present invention offers, in departure from the prior art, are wearable sculptural objects which comprise a collection of parts incapable of disassembly when being worn, but easily disassembled into their constituent components when not being worn. For instance, and without limitation, the present invention comprehends a ring which, once the finger is removed therefrom, collapses from its ring-like form; and a pendant that, when taken from off of a chain, is separable into its component parts.

SUMMARY OF THE DISCLOSURE

The specification describes a wearable decorative article comprising at least first and second separate body components selectively inter-relatable with each other in a predetermined order of assembly to thereby define a unitary article. When the at least first and second separate body components are assembled to define the unitary article, at least the first and second separate body components define a bounded opening dimensioned to receive a retaining member therein. The unitary article is characterized in that it can be completely disassembled into the at least first and second separate body components only if a retaining member is not present in the bounded opening.

According to one embodiment of this invention, the unitary article is a ring, and the bounded opening defined when the at least first and second separate body components are assembled to define the ring is dimensioned to receive the finger of a wearer therein.

According to another embodiment of the present invention, the unitary article is a pendant, and the bounded opening defined when the at least first and second separate body components are assembled to define the pendant is dimensioned to receive a neck-encircling band therethrough.

BRIEF DESCRIPTION OF THE DRAWINGS

The present invention may be better understood with reference to the drawings, of which:

FIGS. 3*a-d* depict the parts and assembly process of a first exemplary pendant form of the present invention.

DESCRIPTION OF THE ILLUSTRATED EMBODIMENTS

Figure 1C:
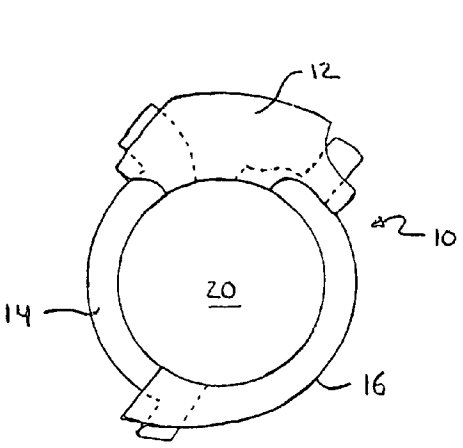
FIGS. 1*a*-1*e* depict the parts and assembly process of a first exemplary ring form of the present invention.

Referring now to the drawings, wherein like numerals indicate like or corresponding parts through the several views, the present invention will be seen to most generally comprise a wearable decorative article including at least first and second separate body components selectively inter-relatable with each other in a predetermined order of assembly to thereby define a unitary, wearable decorative article, such as a ring, pendant, belt buckle, bracelet, etc. When the at least first and second separate body components are assembled to define the unitary wearable decorative article, at least the first and second body components define a bounded opening dimensioned to receive therein a retaining member, such as the finger or wrist of the wearer, a neck-encircling band, a belt, etc. The unitary decorative article is characterized in that it can be completely disassembled into the at least first and second separate body components thereof only if a retaining member is not present in the bounded opening.

Referring first to FIGS. 1*a*-1*e*, a first embodiment of the present invention is shown to comprise a ring form including three separate body components 12, 14, and 16.

Body component 12 is somewhat cylindrical in shape, and has a first aperture 24 at one end thereof and a slightly narrower aperture 26 at the other end thereof. The second aperture 26 will be seen to be slightly offset from the longitudinal axis of the body component 12, opening along a radial axis. The body component 12 is slightly wider at the first end near aperture 24 and tapers slightly near the second end and offset aperture 26. As depicted best in FIG. 1*d*, the body component 12 includes a cut-away portion 22 forming an opening along the principal length thereof.

Referring specifically to FIGS. 1*a*-1*e*, body component 14 is a solid member featuring an arcuate central portion 17 terminating at a first end in a post 34. Post 34 extends from the central portion 17 at a right angle in outward opposition to the arcuate shape of central portion 17. As shown, post 34 is plug-shaped with its narrower end tapering to where it meets the first end of central portion 17. The second, opposite end of central portion 17 terminates at a narrower post 38 which extends from the central portion 17 in substantially right angular opposition to the arcuate shape thereof. The diameter of post 38 is substantially the same as the width of central portion 17.

Figure 1B:
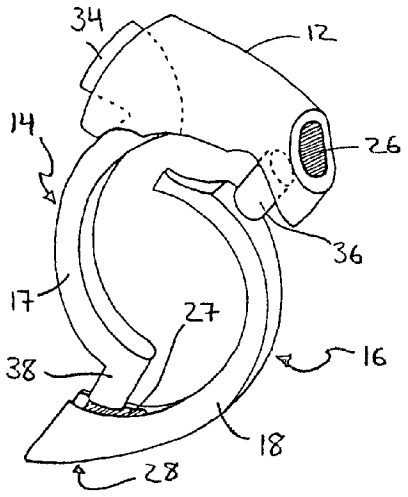
Figure 1A:
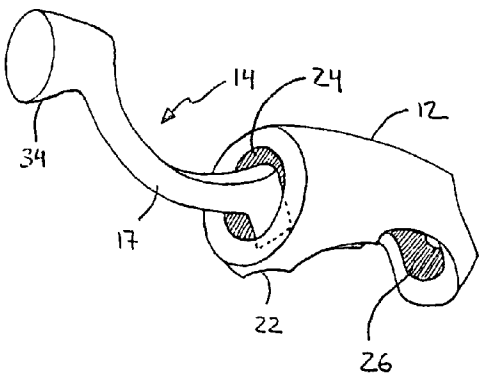
Figure 1E:
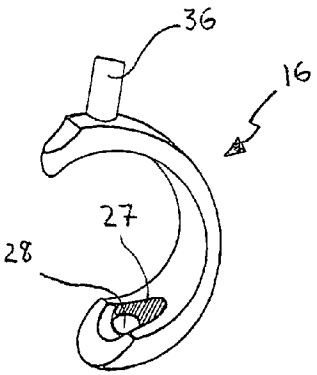
Figure 1D:
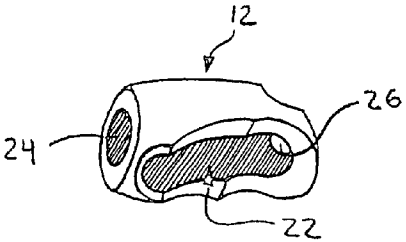

With reference being had particularly to FIGS. 1*b*, 1*c*, and 1*e*, body component 16 will be seen to be characterized by a semi-circular shape featuring a central portion 18. Body component 16 terminates in a tapered first end and flared second end. A post 36 disposed near the tapered end extends outwardly therefrom in a generally perpendicular direction. Recess 27 is cut into the interior portion of the flared end of the body component 16, within which recess is provided an aperture 28 dimensioned to receive therein post 38.

The ring of FIGS. 1*a*-1*e* has only one order of assembly, as follows: First, body component 14 is inserted through aperture 24 of body component 12. Post 38 must be inserted first through aperture 24 from the exterior side of the aperture. As the post 34 of body component 14 is wider than aperture 24, body component 14 cannot be completely pulled through aperture 24. Body component 14 therefore comes to rest at a predetermined position with respect to body component 12. In aid of this, central stem 17 of component 14 comes to rest against the wall of opening 22 in component 12. Next, body component 16 is aligned in such a way that post 36 on body component 16 will slide into aperture 26 on body component 12 while recess 27 and aperture 28 on body component 16 simultaneously receive the second end of central portion 17 and post 38 of body component 14.

Disassembly of ring 10 is achieved by reversing the foregoing assembly process when the user removes the retaining member.

As shown best in FIG. 1*c*, once the foregoing assembly steps have been completed, the interior curved surfaces of body components 12, 14, and 16 collectively define a bounded annular opening 20. The opening 20 is dimensioned to receive a finger (not shown). As will be appreciated by those skilled in the art, with a finger substantially filling opening 20 there would be insufficient clearance for body component 16 to be disassembled from components 12 and 14 particularly as the reverse order of the assembly process, described above, is required. And as body component 14 is retained by body component 16, it also cannot be removed from the assembled article. The presence of a finger in the bounded opening 20 thus prevents disassembly of the ring 10.

In the context of the embodiment of FIGS. 1*a*-1*e*, a finger is considered to constitute a retaining member as it serves to retain the assembled condition of ring 10.

It will be readily apparent that the external appearances of body components 12, 14, and 16 of the foregoing embodiment may be varied to reflect differing designs, sculptures, and materials. For instance, the non-interacting portions of body component 12 could be cut away, adapted to receive mountings for precious stones, ornamented with etchings or filigree, etc. Body components 14 and 16 could be modified in similar fashion. Furthermore, body components 12, 14, and 16 could be constructed from a variety of materials, including precious or non-precious metals, any of numerous alloys, ivories or bones, carvable stones such as jade, or even plastics, epoxies, resins, etc., as well as an combination of the foregoing. Thus, any of the various body components could be assembled with body components of differing materials or designs in order to allow the user to construct a host of overall ring styles.

It will also be appreciated that the design of this first ring form of the present invention can be adapted in such a way as to permit construction from only two body components. In reference to FIG. 1*b*, for instance, it is possible to make body components 12 and 14 in such a way that they constitute not two separate body components, but, rather, a single unitary body component. Such a unitary body component would then mate with the remaining body component 16 as described above. This allows for additional variety in shape and design and further provides for ease of manufacturing and use while still retaining the need for a wearing element to maintain the assembled condition.

Referring next to FIGS. 2*a*-2*d*, another ring-like embodiment of the present invention is shown to comprise three body components 42, 44, and 46, as well as a purely decorative fourth component 48.

Body component 42 is a wide, semi-annular band featuring a series of three cut-away notches or saddles along its exterior circumference. The band is substantially hollow beneath these cut-away portions creating apertures 54, 56, and 58. Aperture 54 resembles a notch at the first terminal portion of the band. Aperture 56 is immediately adjacent to aperture 54 and has an overall saddle shape. Aperture 58 is adjacent to aperture 56 and is the smallest of the three apertures. It also defines a notch or saddle shape in the overall band. Apertures 54, 56, and 58 reside within approximately half the overall circumference of the band. The remaining portion of the band's circumference features an elongated channel 60 cut through the band and coincident with the lower portion of the band's circumference.

Body component 44 also has a substantially semi-circular overall shape. As shown, a portion of the interior circumference of body component 44 is cut away between shoulder 52 and the terminal end of the body component. Aperture 76 radially cuts through this cut-away portion of body component 44. At the opposite end of body component 44 is barb or tab 70 which juts out from the exterior circumference of body component 44.

The main portion of body component 46 is a relatively short arcuate segment having a curvature complimentary to the curvature if the body component 44. A wedge-shaped tongue 66 extends in an orthogonal orientation to the arcuate direction of body component 46. Tongue 66 occupies approximately one-half of the overall surface of body component 46. The other half of body component 46 includes a small, recessed shelf 68.

Body component 48 is substantially spherical in shape and dimensioned to be received in the aperture 58 of body component 42 from the inner side thereof, without passing completely through the aperture 58.

Figure 2C:
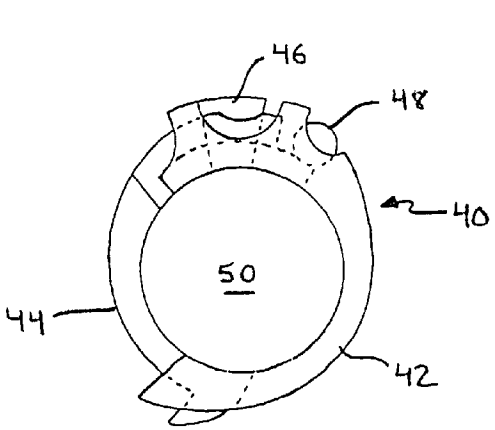
FIGS. 2*a-d* depict the parts and assembly process of a second exemplary ring form of the present invention.
Figure 2B:
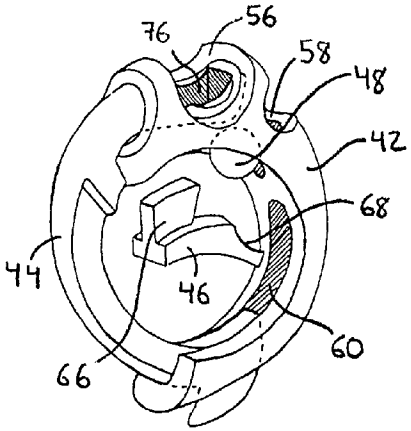
Figure 2A:
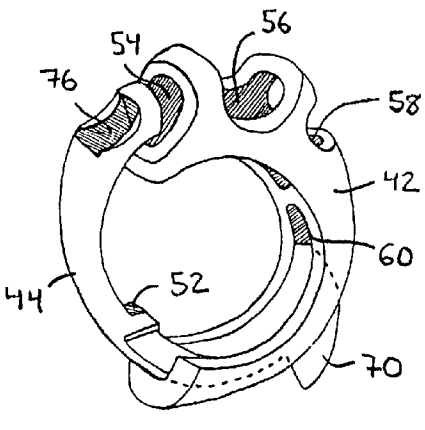
Figure 2D:
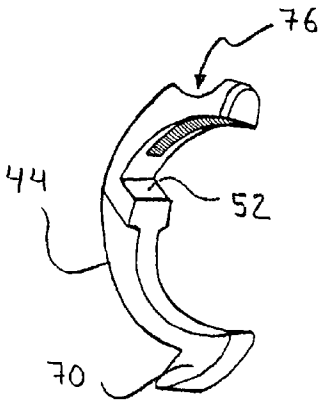

In assembly, the tab 70 of component 44 is slidably received in the elongated channel 60 of component 42. Body component 44 is thereafter rotated around the major axis of the two, joined body components 42 and 44 so that the opposite end of body component 44 is received within the aperture 54 in body component 42. When the tab 70 abuts the end of aperture 60 of body component 42, shoulder 52 comes to rest against the end of component 42, and aperture 76 of body component 44 is aligned with aperture 56 of body component 42, all as depicted in FIG. 2*b*. Next, body component 48 is inserted into aperture 58 of body component 42. Thereafter, tongue 66 of body component 46 is inserted through coincident apertures 76 and 56. Body component 48 is held in aperture 58 by shelf 68 on body component 46. As can best be seen in FIG. 2*c*, body components 42, 44, and 46 cooperate to form the shape of a ring with bounded opening 50. As in the embodiment of FIGS. 1*a*-1*e*, opening 50 is dimensioned to receive a wearer's finger (not shown) as a retaining member. Unlike the embodiment of FIGS. 1*a*-1*e*, the opening 50 of this embodiment is completely defined after the assembly of the two body components 42 and 44. However, it will be understood from the foregoing description that body component 46 is required in order for body component 42 and 44 to maintain their assembled condition after inserting the retaining member. In the present embodiment, body component 48 is purely decorative—the continued assembly of ring 40 is independent of the presence of body component 48.

The presence of the retaining member in the opening 50 prevents disassembly of the ring 40. When a retaining member substantially fills the opening 50, there is insufficient clearance for the user to remove body component 46 from the assembly. Since the shelf 68 of body component 46 cooperates with aperture 58 of body component 42 to retain body component 48, and tongue 66 of body component 46 serves to retain body components 42 and 44 in a locking relationship via apertures 56 and 76, body component 46, is, in effect, a key to disassembly of ring 40. Once the retaining member is removed from opening 50, body component 46 may then be removed from the assembly, thus allowing the remaining body components 42 and 44, and the decorative element 48, to be disassembled in an order reversing that described above.

It will again be appreciated that, as with the other embodiments of the present invention, body components 42, 44, 46, and 48 of the present embodiment may vary widely in design, decoration and material, thus creating a multitude of body component combinations and configurations. Thus, by way of non-limiting example, the decorative element 48 of the present embodiment might itself be a solitary gemstone that may be interchangeably used in other embodiments of the present invention which are likewise adapted to accommodate a body component of this approximate shape and size, such that the gemstone is effectively trapped or caught in each different embodiment. In this fashion, it is possible for a user to acquire a particularly distinct gemstone and feature it in several different wearable decorative articles. Alternatively, differing multiple decorative elements 48 may be provided with any single embodiment of the present inventive article, each such decorative element being interchangeable with the others to thus vary the overall aesthetic.

Turning now to FIGS. 3*a*-3*d*, the wearable decorative article of the present invention will be seen to comprise, in yet another embodiment thereof, a pendant 80 made from body components 82, 84, and 86. As best shown in FIG. 3*a*, body component 82 has an overall ovoid shape with tapered ends. Body component 82 features a large, cut away portion 92 beginning at the central portion of its front face and recessed in a tapered fashion toward its upper, pointed end. Body component 82 also has a semi-circular cut away portion 100 on its back face. The large cut-away portion 92 reveals an interior face 99 and a substantially circular aperture 94 therethrough. Aperture 94 in body component 82 is dimensioned to receive body component 84 therethrough. This same interior face 99 has a second aperture 96 which tapers and continues through to appear near the top end of the front face of body component 82. This particular embodiment also features a channel 88 running along the length of the front face of body component 82 and interrupted only by the large cut-away 92.

Body component 84 is characterized by a hook or "J" shape featuring a central stem 104 which terminates in a flattened and narrowed nose portion 108 at one end and an arcuate anchor portion 110 at the other end. Nose portion 108 accommodates aperture 106. Both nose portion 108 and central stem portion 104 are dimensioned to pass through aperture 94 in body component 82. By reason of its arcuate shape, and its interrelation with the other body components, as hereinafter described, the anchor portion 110 is prevented from passing through the aperture 94.

Body component 86 is characterized by a tapered "horn" shape. Notch 102 defined near the wide end of the body components 86 is positioned so as to align with large cut-away 92 of body component 82 when body component 86 is inserted into aperture 96.

When body component 84 is fitted with body component 82, aperture 106 of body component 84 aligns with aperture 96 of body component 82. Next, body component 86 is inserted through the aligned apertures 96 and 106 to complete the assembly of pendant 80. Notch 102 of body component 86 cooperates with cut-away 92 in body component 82 to create bounded opening 90, as best shown in FIG. 3*d*. Opening 90 is dimensioned to receive a retaining member in the form of a chain (not shown). The chain resides within the confines of notch 102, thus preventing body component 86 from being withdrawn or disassembled while the chain is present. Since the tip of body component 86 protrudes through aperture 96 of body component 82 and aperture 106 in body component 84, the presence of body component 86 prevents the withdrawal of body component 84 from component 82. As long as the retaining member is present in opening 90, body component 86 cannot be withdrawn and, therefore, body component 84 cannot be disassembled. Once the chain is removed from opening 90, body component 86 easily falls away from apertures 96 and 106 and body component 84 is thereafter easily separated from body component 82.

As with the other embodiments already described, body components 82, 84, and 86 may feature a variety of materials, sculptural shapes and elements, and detail work, offering an array of choices to the user.

Figures 4A, 4B, 4C:
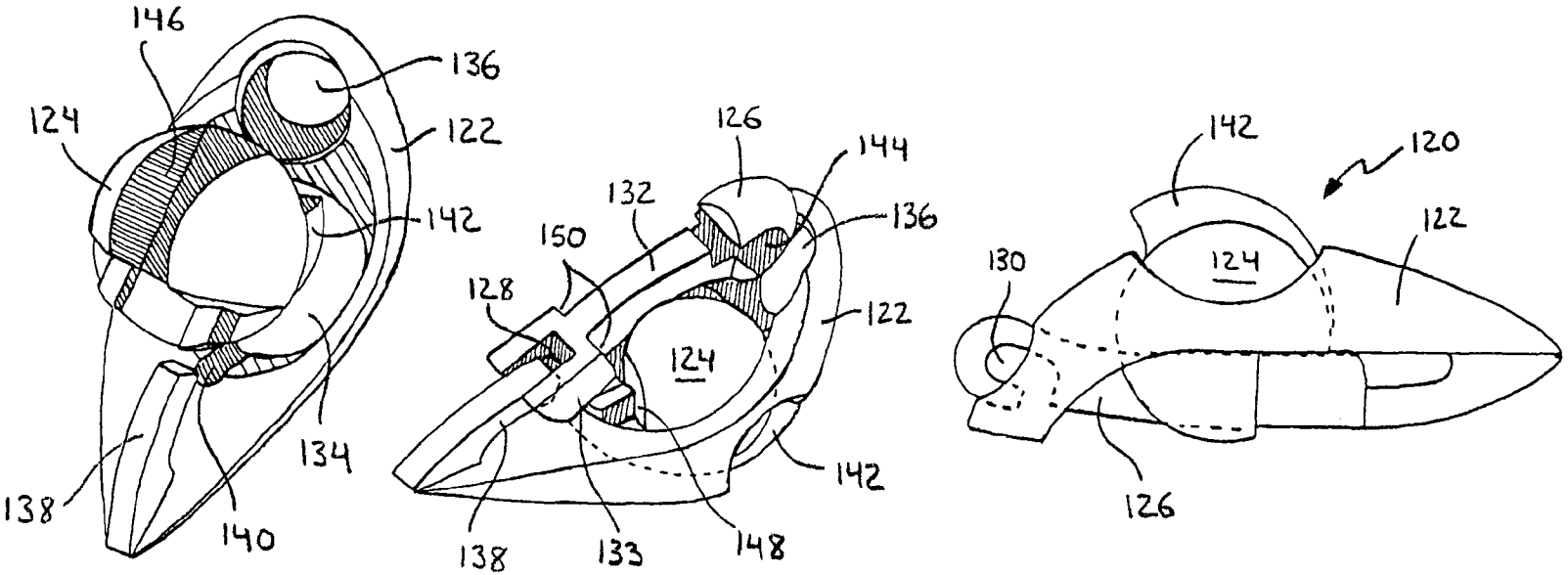
FIGS. 4*a-c* depict the parts and assembly process of a second exemplary pendant form of the present invention.

FIGS. 4*a*-4*c* show a further embodiment of a pendant form of the present inventive wearable decorative article, according to which embodiment the pendant 120 is assembled from body components 122, 124, and 126.

Body component 122 has an overall "teardrop" shape and is substantially rounded on its front side and substantially flat on its back side. Body component 122 has a large, centered hollow on its back side, and the hollow is cut through the front portion to form a large, round aperture 134 in the center of the component and a smaller, round aperture 136 located near the rounded end of body component 122. The back portion of body component 122 also features a large protrusion 138 beginning at the narrow tip of the body and extending away and up the body approximately to where the hollow cut-away portion begins for aperture 134.

Body component 124 is of a substantially spherical shape overall. The front portion of body component 124 features a ridge 142 rising from the surface of the sphere. The ridge 142 features radially increasing dimensions and terminates at a point radially furthest from the center of body component 124 with an upwardly pointed, hook-shaped end. Body component 124 further features a channel 146 cut to a depth of about half of the thickness of the body component 124. The lower half of the back portion of the body component 124 is substantially cut away to define a flat portion 148. Body component 124 is dimensioned to be received in aperture 134 of body component 122 without passing completely therethrough.

Body component 126 has a central shaft portion 132. One end of the shaft portion is rounded and contains a cut-away 144. The other end of shaft portion 132 abuts a square-shaped end portion 133. The junction of shaft portion 132 and end portion 133 creates shoulders 150 on either side of shaft portion 132 at its junction with end portion 133. End portion 133 includes a rectangular, recessed portion 128 dimensioned to accommodate protrusion 138 on body component 122.

In assembly of the decorative article of this embodiment, body component 124 is inserted into aperture 134 of body component 122. Ridge 142 of body component 124 cooperates with channel 140 located in recess 134 to aid in aligning body component 124 within the aperture 134. Next, body component 126 is aligned such that recessed portion 128 of end portion 133 receives protrusion 138 of body component 122 therein. Channel 146 in body component 124 then receives shaft portion 132 of body component 126 to allow body component 126 to lay substantially flat against body components 124 and 122. Finally, body component 126 is slid forward toward aperture 136 in body component 122 such that cut-away portion 144 in body component 126 protrudes through aperture 136. This occurs as shoulder portions 150 of body component 126 engage flat portion 148 of body component 124. When assembled, recessed portion 128 of body component 126 is long enough as to remain engaged with protrusion 138 of body component 122 when the shoulders 150 come to rest against flat portion 148 of component 124. This aids in retention of body component 126 when all components are finally assembled.

It will be appreciated that the cut-away 144 of body component 126 cooperates with aperture 136 in body component 122 to create a bounded opening 130 capable of receiving a chain (not shown) or other retaining member.

In the present embodiment, the presence of a chain or other retaining member in opening 130 prevents the disassembly of the pendant 120. When a chain or other retaining member is present in opening 130, body component 126 cannot be withdrawn from aperture 136. Since the removal of body component 124 from body component 122 requires the removal of body component 126, the presence of a retaining member in opening 130 completely prevents the disassembly of the pendant 120. Once the retaining member is removed from opening 130, the pendant 120 may be disassembled by reversing the above-described assembly steps.

Again, as with the other embodiments of the present invention, body components 122, 124, and 126 of the foregoing embodiment may be designed and decoratively enhanced in innumerable ways, thus providing the user with an array of assembly choices. In addition, and also as with the other embodiments, the embodiment described in connection with FIGS. 4*a*-4*c* could be composed, in an alternative arrangement, of two, or more than three, body components. In one variant, body components 122 and 124 could be made as a single body component; in another, body component 124 could be eliminated altogether, and body component 126 adapted to fit aperture 136 in such a way that body component 126 could not pass through aperture 136; and in still another, body component 124 could be made as a two body components, for instance by making the ridge 142 a separate element interrelatable with the spherical portion of the body component 124.

The embodiments described are but four of a potentially unlimited number comprehended by the present invention. Each of the embodiments described contemplates a family of body components that may vary in composition, decoration, or sculptural design. Further, each body component can vary in shape as long as the essential dimensions necessary for assembly remain constant vis-a-vis the associated body components. Such body components may, as indicated, be purposely designed to be interchangeable with body components of other decorative articles according to this invention, or with new body components, thereby creating modular jewelry. Thus, for instance, one or more body components from a ring may be capable of interrelation with the body components of a pendant, or vice versa.

A distinguishing feature of the wearable decorative articles described by the present invention is that each article relies upon a wearer-provided retaining member to prevent disassembly. It will be appreciated that the present invention can be easily applied to other wearable decorative articles such as bracelets, collars, watches, earrings, and belt buckles, to name a few. With the benefit of this disclosure, these and other variants could be easily designed and constructed by those having skill in the art.

Of course, the foregoing is merely illustrative of the present invention, and those of ordinary skill in the art will appreciate that many additions and modifications to the present invention, as set out in this disclosure, are possible without departing from the spirit and broader aspects thereof as defined in the appended claims.

The invention in which an exclusive property or privilege is claimed is defined as follows:

1. A ring comprising at least three rigid, inflexible body components each having one or both of integral portions and openings, the ring having both an assembled state and a disassembled state, the assembled state characterized by the interrelationship of the at least three rigid, inflexible body components via the sliding receipt of the integral portions in the openings to define the ring, and the disassembled state characterized by the complete separation of all of the at least three rigid, inflexible body components from each other;

wherein the assembled state of the ring is characterized in that:

(i) the rigid, inflexible body components collectively define a bounded opening dimensioned to receive therein a wearer's finger which completely fills the bounded opening;

(ii) a single one of the rigid, inflexible body components is interrelated with one or more of the other rigid, inflexible body components so as to fix the relative positions of said other rigid, inflexible body components in the assembled state;

wherein the at least three body components are configured so that said single one of the rigid, inflexible body components must be the first component to be separated from the other rigid, inflexible body components when transitioning from the assembled state to the disassembled state of the ring;

wherein the at least three rigid, inflexible body components are configured so that said single one of the rigid, inflexible body components must be moved into the area of the bounded opening in order to transition from the assembled state to the disassembled state of the ring, and only when the wearer's finger is not positioned in the bounded opening; and wherein the ring can be repeatedly selectively transitioned between the assembled and disassembled states thereof.

2. An article of jewelry comprising at least three rigid, inflexible body components each having one or both of integral portions and openings, the article of jewelry having both an assembled state and a disassembled state, the assembled state characterized by the interrelationship of the at least three rigid, inflexible body components via the sliding receipt of the integral portions in the openings to define the article of jewelry, and the disassembled state characterized by the complete separation of all of the at least three rigid, inflexible body components from each other;

wherein the assembled state of the article of jewelry is characterized in that:

(i) the rigid, inflexible body components collectively define a bounded opening dimensioned to receive therein a retaining member which completely fills the bounded opening;

(ii) a single one of the rigid, inflexible body components is interrelated with one or more of the other rigid, inflexible body components so as to fix the relative positions of said other rigid, inflexible body components in the assembled state;

wherein the at least three rigid, inflexible body components are configured so that said single one of the rigid, inflexible body components must be the first component to be separated from the other rigid, inflexible body components when transitioning from the assembled state to the disassembled state of the article of jewelry;

wherein the at least three rigid, inflexible body components are configured so that said single one of the rigid, inflexible body components must be moved into the area of the bounded opening in order to transition from the assembled state to the disassembled state of the article of jewelry, and only when the retaining member is not positioned in the bounded opening; and wherein the article of jewelry can be repeatedly selectively transitioned between the assembled and disassembled states thereof.

3. The article of jewelry of claim 2, wherein the article of jewelry is a ring and the retaining member is a finger of a wearer of the ring.

* * * * *